United States Patent [19]

Harkness

[11] B 3,981,289

[45] Sept. 21, 1976

[54] AUTOMATIC COMPRESSION RELIEF MECHANISM FOR INTERNAL COMBUSTION ENGINES

[75] Inventor: Joseph R. Harkness, Germantown, Wis.

[73] Assignee: Briggs & Stratton Corporation, Wauwatosa, Wis.

[22] Filed: Mar. 14, 1975

[21] Appl. No.: 558,251

[44] Published under the second Trial Voluntary Protest Program on January 13, 1976 as document No. B 558,251.

[52] U.S. Cl. ..... 123/182

[51] Int. Cl.[2] ..... F01L 13/08

[58] Field of Search ..... 123/182

[56] References Cited

UNITED STATES PATENTS

| | | | |
|---|---|---|---|
| 3,314,408 | 4/1967 | Fenton | 123/182 |
| 3,362,390 | 1/1968 | Esty | 123/182 |
| 3,469,922 | 2/1970 | Campen | 123/182 |
| 3,511,219 | 5/1970 | Esty | 123/182 |
| 3,620,203 | 11/1971 | Harkness | 123/182 |
| 3,897,768 | 8/1975 | Thiel | 123/182 |
| 3,901,199 | 8/1975 | Smith | 123/182 |

*Primary Examiner*—Wendell E. Burns
*Assistant Examiner*—David D. Reynolds

[57] ABSTRACT

In an internal combustion engine, a latch member is movable to and from a latching position in which it prevents a valve from coming nearer its seat than a predetermined distance therefrom. A cam follower connected with the latch member cooperates with axially adjacent first and second cam elements. The first causes the latch member to be held out of latching position during most of the engine cycle at all speeds, but at cranking speeds causes it to move to latching position just before the valve, in closing, reaches said distance from its seat. Once in latching position, the latch member is trapped there until opening movement of the valve carries it beyond said distance from its seat. The second cam element, carried by a flyweight, so cooperates with the first at running speeds as to hold the latch member out of latching position throughout the cycle.

9 Claims, 4 Drawing Figures

AUTOMATIC COMPRESSION RELIEF MECHANISM FOR INTERNAL COMBUSTION ENGINES

This invention relates to a compression relief mechanism by which starting of an internal combustion engine is facilitated, and the invention is more particularly concerned with an automatic mechanism by which a valve that controls flow of gas to or from the engine combustion chamber is prevented from getting closer to its seat than a predetermined small distance therefrom at engine cranking speeds, but is permitted to engage its seat normally at engine running speeds.

Compression relief mechanisms are now incorporated in many of the small internal combustion engines that power such machines as lawn mowers, soil tillers, garden tractors and snow blowers. When an engine that is provided with a compression relief expedient is being cranked, its cylinder is vented through a partially open valve during at least the compression stroke of the engine cycle, to reduce the torque that must be exerted for cranking the engine. To the extent that gas is permitted to escape from the cylinder past the partially-open valve, there is a diminished force opposing movement of the piston during the compression stroke. Preferably the valve remains in its partially-open position during the subsequent combustion stroke, so that if a charge in the cylinder is not combusting during that stroke, piston movement is not opposed by suction in the cylinder.

Perhaps the simplest and most successful compression relief expedient heretofore devised was that disclosed in the Harkness U.S. Pat. No. 2,999,491, wherein the cam that actuated one of the valves was so shaped as to hold that valve slightly off its seat through a substantial part of every compression stroke. Inasmuch as the valve was held off its seat when the engine was running, just as when it was being cranked, there was some loss of compression when the engine was running, although much less than during cranking, owing to the difference in piston speeds and the small size of the orifice defined by the partly open valve.

The small loss of efficiency that was due to the compression relief expedient of the Harkness patent was inconsequential in small engines, and was heavily outweighed by the starting ease that is afforded and by its low cost, simplicity and dependability. In larger engines, however, the power loss due to that arrangement tended to become significant, and certain other disadvantages became apparent.

With the valve arrangement of the Harkness patent it was not feasible to hold the affected valve off of its seat during any part of the combustion stroke, and therefore the piston suction which could develop during that part of the engine cycle still had to be overcome. Thus starting torque had not been reduced to its lowest possible value, and the difference between what was potentially attainable and what had actually been realized became more and more significant with increasing engine size.

Another problem that appeared when the arrangement of the Harkness patent was applied to a relatively large engine had to do with the effects of heat upon the valve and the engine body. In its compression-relieving position the affected valve was required to be at a rather accurately predetermined distance from its seat. If it was held too far off its seat, leakage past it was excessive and engine efficiency suffered; if it was held at less than the specified distance from its seat, it did not permit as much leakage as was needed to assure the desired reduction of cranking torque. Most single-cylinder engines have aluminum bodies, and the engine body therefore has a substantially different rate of thermal expansion than the valve stems and their tappets. With a small engine this differential expansion did not result in any significant change, as between a hot and a cold engine, in the distance between the valve and its seat when the valve was in its compression relieving position. In a larger engine, however, the difference became significant.

It is apparent that a need has developed for a compression relief mechanism which is suitable for large engines and which is simple, inexpensive and dependable, does not affect engine efficiency, and functions equally as well when the engine is hot as when it is cold; and one of the objects of the present invention is to provide a compression relief mechanism that meets this need.

However, it is also extremely desirable to provide a compression relief mechanism for small engines that is superior in certain respects to the expedient of the Harkness patent.

The smaller single-cylinder engines are quite commonly used for powering rotary lawn mowers. When the operator of such a mower leaves his operating position (at the handle of a walk-behind mower or on the seat of a riding mower), it is desirable, for his own safety and for the safety of others, that the mower blade be stopped. The simplest way to achieve stopping of blade rotation at such times is to cause the engine to stop, and it is obvious that any of a number of dead-man-control expedients can be employed for shutting off the engine. The problem, of course, is that the engine has to be restarted when the operator returns to his position, and if the engine cannot be very easily turned over and very quickly restarted, the operator may be goaded into finding some means to defeat the safety device.

What this means is that the provision of safe operating features on a power lawn mower or a similar machine cannot be a realistic success unless the engine that powers the machine is one that has a completely effective compression relief mechanism. As pointed out above, the commercially successful arrangement of the Harkness patent did not actually achieve the utmost reduction in starting torque inasmuch as it did not afford relief of suction through an unfired combustion stroke.

With this in mind it is another object of this invention to provide compression relief mechanism which is suitable for internal combustion engines of all sizes and which allows the engine to be turned over with a very minimum of cranking torque, so that the engine can be repeatedly stopped and restarted with negligible inconvenience to an operator.

It goes without saying that a commercially satisfactory compression relief mechanism should require no attention on the part of an operator of the engine on which it is installed, and should thus be fully automatic. Furthermore, in view of the widespread concern with efficient utilization of energy resources, easy starting of an engine should not be obtained at the cost of any sacrifice of engine efficiency.

It is therefore another object of this invention to provide a compression relief mechanism which affords the utmost starting ease but which is fully automatic, so that it requires no attention on the part of an operator, and whereby compression relief is effected only during actual starting of the engine but normal valve operation is permitted when the engine is running under its own power so that engine efficiency is not impaired.

In attaining its objectives, the present invention contemplates the provision of a latch member which is movable to and from a latching position in which the latch member can be engaged by an abutment on a part which is connected with the valve to move axially with it, such as the valve stem or the tappet. By such engagement the latch member can prevent the valve from moving all the way to its seat. The invention further contemplates the provision of means comprising a centrifugally actuated device that allows the latch member to occupy its latching position when the engine is turning over at cranking speeds but holds the latch member out of that position when the engine is at running speeds.

Apparatus of the broad general character just described is disclosed in the 1912 British patent to Leitner, No. 28,286. However, the provision of such a latching apparatus involves problems that were neither recognized nor taken into account by Leitner, and an understanding of the nature of those problems is necessary to a full appreciation of the present invention and its objects.

An automatic centrifugally actuated mechanism that moves a latch member into a latching position for engine starting and holds the latch member out of that position when the engine is running must be designed with due regard for the fact that the valve has a rather fast motion even when the engine is running slowly, and that relatively powerful forces are imposed upon the valve for its actuation. In order for the latch member to occupy its latching position during starting, it must be brought to that position while the engine is coasting to a stop from a previous period of operation. But because of the speed and power with which the valve is actuated, the timing of latch member movement to the latching position is critical in relation to the engine cycle as well as in relation to engine speed. If the latch member has come only partway into its latching position at the time the abutment on the valve stem or tappet comes into engagement with it, the high forces of the valve and its spring will be exerted upon only a small part of the surface of the latch member. The abutment will thus act upon the latch member like the punch or die of a punch press, chewing dents and nicks into it and sooner or later rendering it useless.

When the valve is moving to and from its fully open position there should obviously be no interference between the latch member and the valve, and the best way to prevent such interference is to keep the latch member out of its latching position at all times during the engine cycle when such interference might otherwise occur. This is to say that even at cranking speeds there are certain times during the engine cycle when the latch member should be held out of its latching position.

The compression relief mechanism of the old British Leitner patent was responsive only to engine speed. The movements of its latch member to and from the latching position took place without regard to the part of the engine cycle in which they were occurring.

By contrast, it is of course an object of the present invention to provide an automatic compression relief mechanism wherein a latch member cooperates with an abutment on a valve tappet or a valve stem, and wherein movement of the latch member to and from its latching position, in which it cooperates with the abutment, is timed in relation to the engine cycle as well as being dependent upon engine speed.

It follows that another and more specific object of this invention is to provide an automatic compression relief mechanism which is suitable for a high speed engine and which has a long useful life.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 1 is a view mainly in elevation, with portions cut away and shown in section, of those parts of a gasoline engine that embody the principles of this invention, namely, one of the valves and its actuating mechanism, together with the automatic compression relief mechanism of this invention by which that valve is prevented from approaching nearer to its seat than a predetermined small distance therefrom when the engine is turning at cranking speeds;

Referring now more particularly to the accompanying drawings, the numeral 5 designates one of the valves of an internal combustion engine. The valve 5, which can be either an exhaust valve or an intake valve, controls flow of gas between a port 6 and the combustion chamber of the engine. The combustion chamber is not specifically illustrated but will be understood to be denoted by the area above the valve 5.

Figure 1:
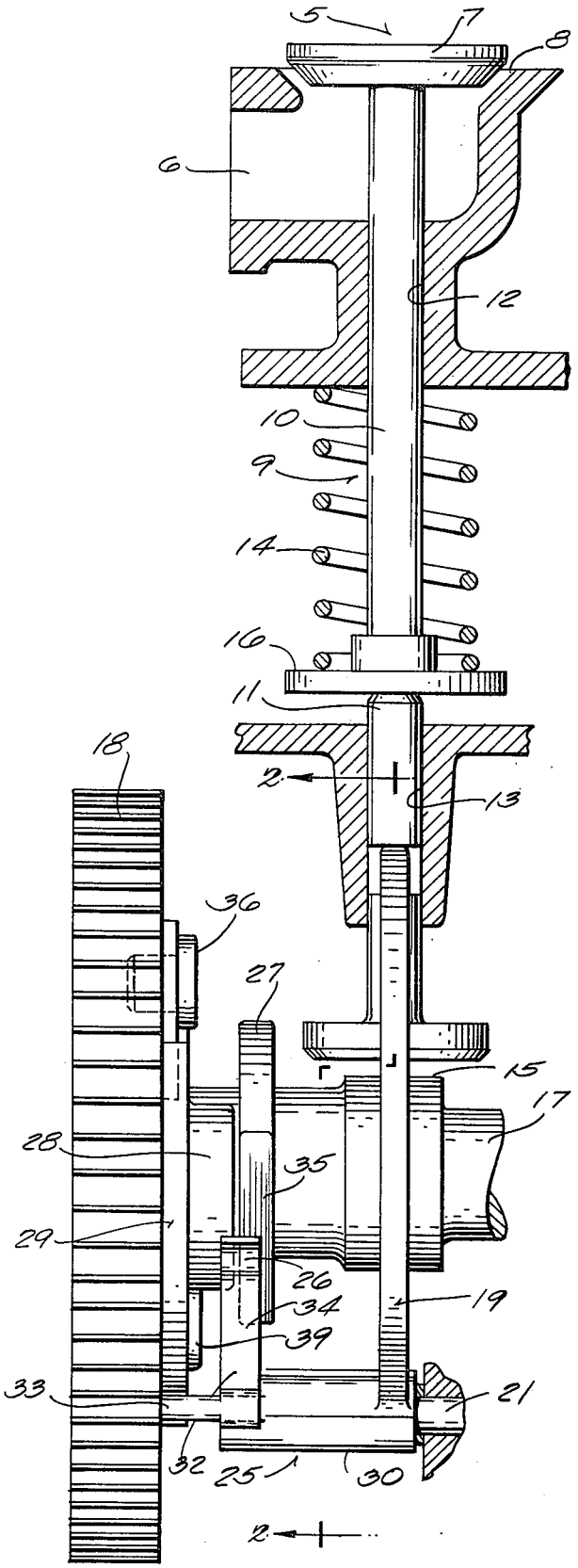

The valve is of the usual poppet type, having a head 7 that moves to and from engagement with a circumferential seat 8 and constitutes the valve proper, the valve being closed when the head is engaged with its seat. The valve has an axially movable part 9 that provides for its actuation between its closed position and an open position in which the head is spaced at a substantially greater distance from the seat than it is shown in FIG. 1. The axially movable part 9, as is more or less conventional, comprises a stem 10 that is integral with the head 7 and extends downwardly therefrom, and a coaxial tappet 11 that is separate from the stem and beneath the same. The valve stem 10 is confined to axial motion in a valve guide 12 in the engine body, and the tappet 10 is similarly confined by a coaxial tappet guide 13 in the engine body.

The valve is actuated for its opening and closing motion by actuating means comprising a valve spring 14 and a valve cam 15. The valve spring, as is conventional, surrounds the valve stem and reacts between the underside of the valve guide and a spring retainer 16 on the bottom of the valve stem, to bias the valve towards its closed position. The valve cam 15, which is on a camshaft 17 that rotates in timed relation to the engine cycle, cooperates with the tappet to drive the valve to its open position against the biasing force of the valve spring and to control the spring propelled return of the valve towards engagement with its seat.

The camshaft may be driven for its rotation by means of a cam gear 18, which, as is conventional, meshes with a timing gear (not shown) on the engine crankshaft (not shown).

Figure 2:
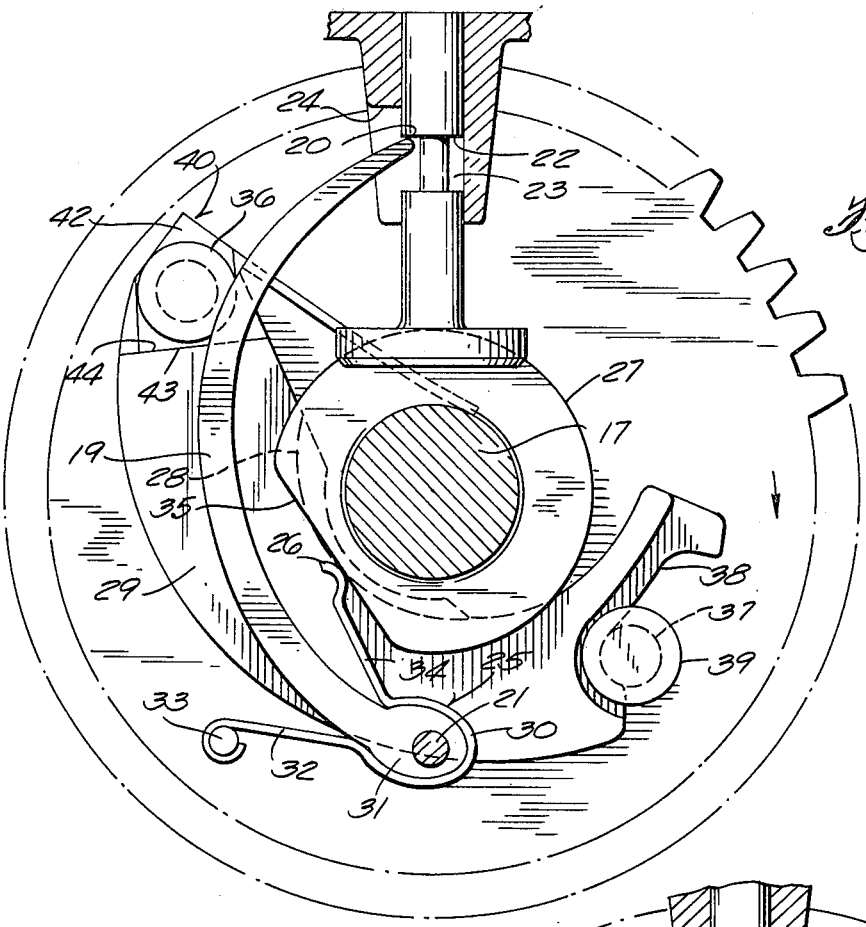
FIG. 2 is a sectional view taken on the plane of the line 2—2 in FIG. 1, illustrating the compression relief mechanism in its operating position in which it prevents the valve from engaging its seat.

According to the present invention, when the camshaft is rotating at engine cranking speeds, and during portions of the engine cycle that comprise the compression and combustion strokes, the valve is prevented from engaging its seat by means of a latch member 19 that comprises an arcuate or crescent-shaped lever which curves around the camshaft. At its lower end, beneath the camshaft, the arcuate lever has a pivotal fulcrum connection 21 to a relatively fixed part of the engine body, to enable the upper end portion of the latch member to swing to and from a defined latching position in which it is illustrated in FIG. 2. The fulcrum connection 21 is so disposed that the axis about which the latch member swings is parallel to the camshaft axis and intersects the valve axis.

In the latching position of the latch member, an abutment 20 on its upper end portion is engageable by an abutment 22 on the axially movable part 9 of the valve. In this case the abutment 22 is illustrated as a circumferential downwardly facing shoulder on the tappet, defined by a reduced diameter neck portion 23 of the tappet that is intermediate its top and bottom ends. In the tappet guide 13 there is a laterally opening slot 24 through which the latch member can swing to and from its latching position.

When the abutment 22 on the tappet engages the latch member, the valve cannot be moved all the way onto its seat by the valve spring. Instead, the latch member holds the valve in a partly open compression-relieving position, illustrated in FIG. 1, in which the valve is at a predetermined small distance from its seat. That distance is so chosen as to permit gas to leak out of the cylinder to the extent necessary to assure substantially complete relief of compression and suction while nevertheless allowing enough gas to remain in the chamber for combustion at the conclusion of a compression stroke.

Cooperating with the arcuate lever 20 to swing the latch member 19 to and from its latching position are a hairpin-shaped leaf spring 25 that comprises a cam follower 26, a first cam element 27 that is constrained to rotate with the camshaft, and a second cam element 28 that is carried by a centrifugally responsive flyweight 29.

The hairpin-shaped leaf spring 25 has its bight portion 30 closely embracing an elliptical hub portion 31 on the arcuate lever. The outer end of one leg 32 of that spring is connected, as at 33, with a relatively fixed part of the engine body. The outer end of the other leg 34 of the spring comprises the cam follower 26. The two cam elements 27 and 28, which are described below, are axially adjacent to one another, and the spring 25 is sufficiently wide from edge to edge so that its cam follower portion 26 can be engaged by both the cam elements. The spring is of course confined against edgewise motion by its connection 33 with the engine body and by its connection with the hub portion 31 on the arcuate lever, the arcuate lever being confined by its pivotal connection 21 to swinging motion about the axis of that connection.

Figure 3:
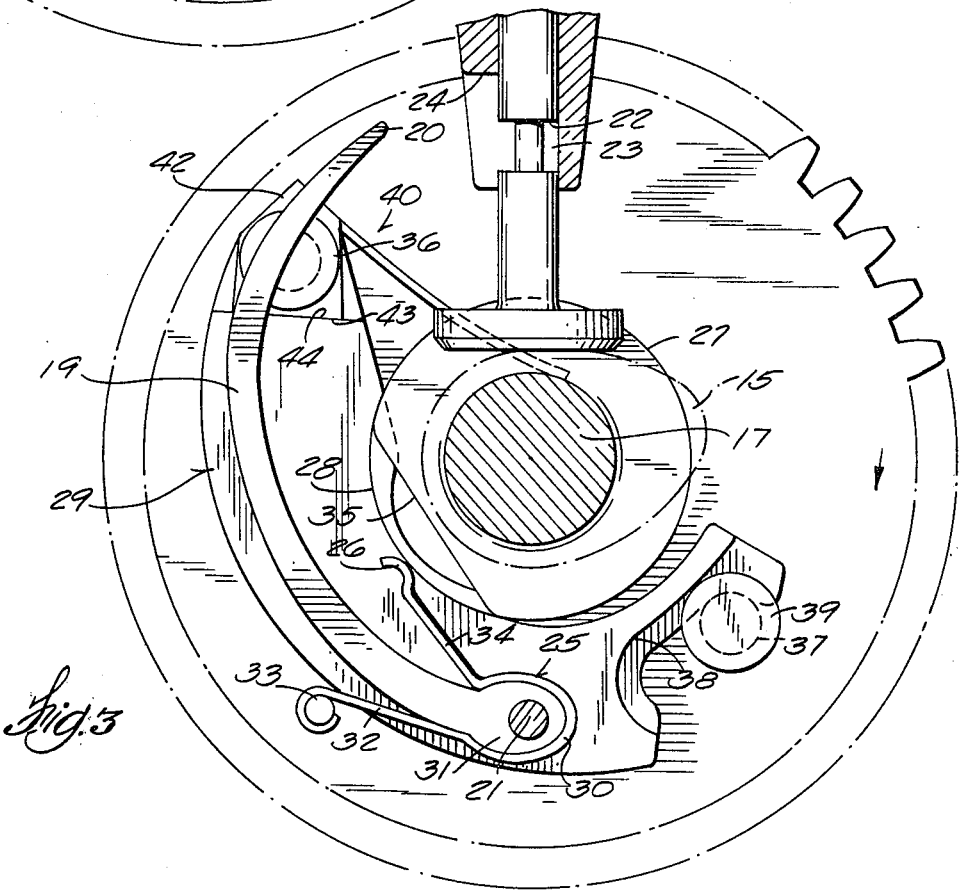
FIG. 3 is a view generally similar to FIG. 2 but illustrating the condition of the compression relief mechanism of this invention when the engine is at running speed and is in the same part of its cycle as is illustrated in FIG. 2.

The cam follower 26 is movable between a defined latch enabling position, in which it is relatively near the camshaft axis and in which it is illustrated in FIG. 2, and a latch disabling position in which it is farther from the camshaft axis and in which it is illustrated in FIG. 3. Inasmuch as the outer ends of the legs 32 and 34 of the hairpin spring must be converged against resilient bias, the spring urges the cam follower towards its latch enabling position.

The hairpin spring also serves to provide a resilient lost motion connection between the cam follower and the latch member. This is owing to the snug embrace of the bight portion 30 of the spring around the elliptical hub portion 31 of the arcuate lever and the immobilization of the outer end of the leg 32 of the spring. In effect, movement of the cam follower 26 in one direction or the other causes a corresponding flexure of the bight portion of the spring relative to the legs thereof, and the force of such flexure is imposed upon the arcuate lever.

When the cam follower is in its latch enabling position, it biases the latch member towards its latching position if the latch member is out of that position, but it imposes little or no bias upon the latch member once the latch member reaches the latching position. Conversely, if the cam follower is in its latch disabling position, it biases the latch member away from the latching position so long as the latching member is in that position, but once free of the abutment 22, the latch member goes to a defined inoperative position, illustrated in FIG. 3, in which position it is established and confined by the hairpin spring until the cam follower once again moves back to its latch enabling position.

Before explaining how the cam elements 27 and 28 cooperate with the cam follower, it should be pointed out that once the latch member is engaged by the abutment 22 on the tappet, the latch member is confined or trapped in its latching position under the force of the valve spring, and it remains so confined until the valve cam 15 once again moves the valve to beyond the compression-relieving distance from its seat. While engaged by the abutment, the latch member resists dislodgement from its latching position because the pivot axis of the arcuate member, in being located to intersect the valve axis, is in line with the direction in which the valve spring exerts its rather substantial force. Thus the arrangement that confines the latch member in its latching position is somewhat similar to that of a toggle linkage in its overcenter locked condition.

The first cam element 27, which is constrained to rotate with the camshaft 17 and which is located between the valve cam 15 and the cam gear 18, has a uniformly large radius cam surface around most of its perimeter and has a smaller radius "low" 35 around the rest of its perimeter. During a major portion of the engine cycle the larger radius portion disposes the cam follower 26 in its latch disabling position. The low 35 allows the cam follower to occupy its latch enabling position, but as explained below, the cam follower is permitted to assume that position only when the engine is turning over at cranking speeds. Specifically, the low comes under the cam follower at a time when the valve is closing and before it reaches the predetermined compression-relieving distance from its seat. Therefore, at cranking speeds the latch member is moved fully to its latching position in time to be squarely engaged by the abutment 22 on the descending tappet.

Owing to the configuration of the first cam element 27, which assures that the rather substantial force of the valve spring will always be imposed upon an adequate surface area of the latch member, attainment of the utmost strength is not of primary importance in the design of the arcuate lever. Therefore, in selecting the material of which the arcuate lever is made, due consideration can readily be given to thermal expansion characteristics. If the arcuate lever expands and contracts at the correct rate in relation to thermal expansion and contraction of the engine body, the valve stem and the tappet, assurance is had that when the valve is held in its compression-relieving position, the distance between the valve and its seat will always be the same, whether the engine is hot or cold.

Once engaged by the abutment 22, the latch member remains in its latching position, trapped by the valve spring, all during the subsequent interval in which the valve cam 15 would allow the valve to be closer to its seat than the latch member permits. During a substantial final portion of that interval the larger radius cam surface of the first cam element 27 is in engagement with the cam follower 26, and the cam follower is therefore disposed in its latch disabling position. However, the trapped latch member cannot respond to the biasing force that urges it away from its latching position until the valve cam moves the valve to slightly beyond the compression-relieving distance from its seat, and then the latch member promptly snaps over to its inoperative position.

When the engine is at running speed, the second cam element 28, which is carried by the flyweight 29, in effect supersedes the low 35 on the first cam element and supplements the larger radius portion of the first cam element to maintain the cam follower in its latch disabling position all through the engine cycle.

Figure 4:
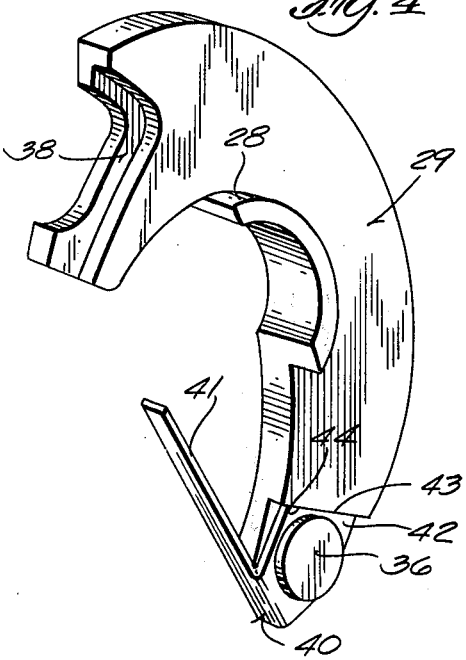
FIG. 4 is a perspective view of the flyweight of the compression relief mechanism.

The second cam element 28 can be formed integrally with the flyweight, as a more or less flange-like arcuate protuberance thereon (see FIG. 4). The flyweight is carried by the cam gear 18, with which it is constrained to rotate, but it is movable relative to the cam gear between an at-rest position to which the flyweight is biased and a running position to which the flyweight is centrifugally propelled. The flyweight is generally flat, to overlie the flat face of the cam gear that is adjacent to the first cam element 27, and it is more or less C-shaped in outline so that it curves around the camshaft. The second cam element is at the inner edge of the flyweight, intermediate the ends thereof.

A pivot pin 36 extends through a captive end portion of the flyweight and is secured to the cam gear, at one side of the camshaft, to permit the flyweight to swing edgewise relative to the camshaft in directions transverse to the camshaft axis. The limits of such swinging motion are defined by a stop pin 37 which projects from the cam gear at a location diametrically opposite the pivot pin 36 and which cooperates with abutments on the flyweight that are defined by a bay 38 in its outer edge, near its free end. As shown, the marginal portion of the flyweight adjacent to the bay 38 is of reduced thickness and is overlain by a flange-like head 39 on the stop pin that confines the flyweight to edgewise swinging motion.

The flyweight is biased towards its at-rest position, in which the second cam element 28 on it is nearest the camshaft axis, by means of a leaf spring 40 that is formed in one piece. The spring 40 comprises a flat, elongated spring arm 41 and a securement portion 42 that is bent from the spring arm to lie in a plane normal to the spring arm and parallel to its length. The securement portion 42 has a straight edge 43 and has a hole through which the flyweight pivot pin extends. The said securement portion flatwise overlies the captive end portion of the flyweight, which is of reduced thickness to define a straight shoulder 44 against which is engaged the straight edge 43 on the spring, thus enabling spring force to be imposed upon the flyweight. The free end of the spring arm 41 bears against the camshaft, at the side thereof that is opposite the medial portion of the flyweight, to maintain flexing stress in the spring by which the flyweight is urged towards its at-rest position.

When the flyweight is in its at-rest position, the second cam element 28 is so close to the camshaft axis that it allows the cam follower 26 to occupy the latch enabling position that it is permitted to attain by the low 35 on the first cam element. However, when the flyweight is centrifugally propelled to its running position, the second cam element occupies a position more distant from the camshaft axis and in which it prevents the cam follower from engaging the low 35. The second cam element thus acts at running speeds to prevent the cam follower from moving to its latch enabling position, so that when the engine is running the latch member is kept out of its latching position and cannot interfere with normal valve movement.

From the foregoing description taken with the accompanying drawings it will be apparent that this invention provides a simple, inexpensive and dependable automatic compression relief mechanism which is equally suitable for large engines and for small ones, relieves suction during an unfired combustion stroke as well as relieving compression, is equally effective to facilitate starting a hot engine or a cold one, and causes no loss of efficiency as compared with an engine not equipped for compression relief.

Those skilled in the art will appreciate that the invention can be embodied in forms other than as herein disclosed for purposes of illustration.

The invention is defined by the following claims:

1. In an internal combustion engine having a valve which controls flow of gas through a port communicable with the engine combustion chamber, and valve actuating means by which the valve is moved axially between its seat and an open position, and wherein said valve actuating means comprises a valve spring biasing the valve for closing motion towards its seat, a camshaft rotatable in timed relation to the engine cycle, and means comprising an axially movable part connected with the valve and a cam constrained to rotate with the camshaft for cyclically moving the valve in the opening direction, automatic compression relief mechanism whereby the valve is prevented from getting nearer to its seat than a predetermined small distance therefrom at engine cranking speeds but is permitted to engage its seat normally at engine running speeds, said mechanism comprising:

A. a latch member;

B. mounting means confining the latch member to motion substantially transverse to the direction of movement of said part, between defined latching and inoperative positions;

C. cooperating abutment means on the latch member and on said part, engageable when the latch member is in its latching position to restrain the valve against movement through said distance to its seat, said abutment means cooperating with the valve spring and the mounting means to confine the latch member against movement out of its latching position whenever the valve actuating means tends to dispose the valve at less than said distance from its seat;

D. a cam follower movable between defined latch enabling and latch disabling positions;

E. means providing a resilient lost motion connection between the cam follower and the latch member whereby movement of the cam follower from its latch enabling position to its latch disabling position biases the latch member away from its latching position and motion of the cam follower from its latch disabling position to its latch enabling position biases the latch member away from its inoperative position; and F. cam means cooperable with the cam follower to dispose the same in its latch enabling position only when the engine is at cranking speeds, and then only during a minor portion of the engine cycle that begins during closing motion of the valve and at a time when the valve is more than said distance from its seat, and to dispose the cam follower in its latch disabling position at all other times, said cam means comprising 1. a first cam element constrained to rotate with the camshaft and which is arranged to engage the cam follower through all but said minor portion of every engine cycle, and
2. a centrifugally responsive second cam element which is complementary to the first cam element and which is carried by the camshaft for rotation therewith and for motion relative thereto between a pair of defined positions, towards one of which it is biased and towards the other of which it is centrifugally propelled, said second cam element being arranged to engage the cam follower during said minor portion of the engine cycle, but only when said second cam element is in one of its said positions.

2. An internal combustion engine having an axially movable valve which cooperates with a seat to control flow of gas between a combustion chamber and a zone outside the combustion chamber, a valve spring biasing the valve for closing motion towards the seat, a camshaft rotatable in timed relation to the engine cycle, and means comprising an axially movable part connected with the valve and a cam constrained to rotate with the camshaft for cyclically imparting opening motion to the valve, said engine being characterized by automatic compression relief mechanism whereby the valve is prevented from getting nearer to its seat than a predetermined small distance therefrom at engine cranking speeds but is permitted to engage its seat normally at engine running speeds, which mechanism comprises:

A. an elongated latch lever having an abutment at one end portion thereof and which is fulcrumed at its other end portion to swing between defined latching and inoperative positions about a fixed axis that substantially intersects the axis of said part;

B. means on said part defining an abutment that is engageable with said abutment on the latch lever when the latter is in its latching position, the engagement of said abutments preventing the valve from getting nearer to its seat than said predetermined distance therefrom and confining the lever against movement out of its latching position;

C. a cam follower movable between defined latch enabling and latch disabling positions;

D. resilient means providing a lost motion biasing connection between the cam follower and the latch lever whereby movement of the cam follower from its latch enabling position to its disabling position biases the latch lever away from its latching position and movement of the cam follower from its latch disabling position to its latch enabling position biases the latch lever away from its inoperative position; and E. cam means cooperating with the cam follower and operative at engine cranking speeds to dispose the cam follower in its latch enabling position during a minor portion of the engine cycle that begins at a time during valve closing motion when the valve is at more than said predetermined distance from its seat, but operative at all other times to maintain the cam follower in its latch disabling position, said cam means comprising 1. a first cam element constrained to rotate with the camshaft and configured to dispose the cam follower in its latch disabling position during all but said minor portion of the engine cycle, and
2. a centrifugally responsive second cam element complementary to the first cam element, said second cam element being carried by the camshaft for rotation therewith and for motion relative thereto between defined limits, towards one of which it is biased and towards the other of which it is centrifugally propelled, and said second cam element being configured to engage the cam follower only when it is at one of its said limits, and then only during said minor portion of the engine cycle.

3. An internal combustion engine having an axially movable valve which cooperates with a seat to control flow of gas between a combustion chamber and a zone outside the combustion chamber, a valve spring biasing the valve for closing motion towards the seat, a camshaft that rotates in timed relation to the engine cycle, and means comprising an axially movable part connected with the valve and a cam constrained to rotate with the camshaft for cyclically imparting opening motion to the valve, said engine being characterized by automatic compression relief mechanism that prevents the valve from getting nearer to its seat than a predetermined small distance therefrom when the camshaft is rotating at engine cranking speeds but permits the valve to engage its seat normally when the camshaft rotates at higher speeds, which mechanism comprises:

A. means defining an abutment on said part that faces substantially in the direction of its valve closing motion;

B. an elongated latch lever having an abutment at one end portion thereof and having a noncircular hub portion at its other end;

C. means at said hub portion fulcrumming the lever for swinging motion about an axis transverse to and substantially intersecting the axis of said part, by which motion said one end portion of the lever is carried between an inoperative position in which the lever is clear of the part and a latching position in which said abutment on the lever is engageable by said abutment on the part to restrain the valve against motion through said distance to its seat, such engagement, under the bias of the valve spring, also confining the lever against motion out of its latching position;

D. a substantially hairpin shaped spring 1. having one leg that has its outer end fixed in relation to the axis about which the lever is fulcrummed,
2. having at the outer end of its other leg a cam follower which is movable between a latch enabling position and a latch disabling position and which the spring biases towards one of said positions, and
3. having its bight portion snugly embracing the hub portion of the latch lever so that the latch lever is biased away from its latching position in consequence of movement of the cam follower from its latch enabling position to its latch disabling position and is biased away from its inoperative position in consequence of movement of the cam follower from its latch disabling position to its latch enabling position; and E. cam means by which the cam follower is caused to occupy its latch enabling position only when the camshaft is rotating at engine cranking speeds, and then only during a minor portion of the engine cycle that begins when the valve is in closing motion and is at more than said distance from its seat, and by which the cam follower is maintained in its latch disabling position at all other times, said cam means comprising a centrifugally responsive cam element carried by the camshaft for rotation therewith and for motion relative thereto between one position to which the cam element is biased and another position to which it is centrifugally propelled against its bias, said cam element being engageable with the cam follower only when said cam element is in one of its said positions and then only through said minor portion of the engine cycle.

4. The internal combustion engine of claim 3 wherein said cam follower is biased to its latch enabling position and wherein said cam element engages the cam follower only when in its said other position to which it is centrifugally propelled, further characterized by:

a second cam element constrained to rotate with the camshaft and which is arranged to engage the cam follower and maintain it in its latch disabling position through all portions of the engine cycle other than said minor portion, said second cam element permitting the cam follower to move to its latch enabling position, under the flexing bias of said spring, during said minor portion of the engine cycle.

5. In compression relief mechanism for an internal combustion engine that has a valve movable towards and from engagement with a seat to control flow of gas between the interior of a combustion chamber and a zone external to the combustion chamber, and valve actuatinng means comprising a spring which biases the valve in one direction towards the seat and a cam on a camshaft that rotates in timed relation to the engine cycle, said compression relief mechanism comprising means defining an abutment on a part constrained to move along a defined axis in unison with the valve, which abutment faces substantially in said one direction, and a latch member movable to and from a latching position which it occupies only when the camshaft rotates at engine cranking speeds and wherein it is engaged by said abutment to prevent the valve from coming nearer to its seat than a predetermined small distance therefrom, said latch member being characterized by:

A. the latch member comprising an elongated arcuately curved lever having a portion near one end thereof that is engageable by said abutment; and B. said lever being pivoted near its other end for swinging motion of the first mentioned end thereof about a fulcrum axis which extends substantially transversely to the axis of motion of said part and substantially intersects the same, so that once engaged by said abutment, the lever tends to remain in its latching position until the valve is moved to more than said distance from its seat.

6. The compression relief mechanism of claim 5, further characterized by:

C. said fulcrum axis being located at the opposite side of the camshaft from said part.

7. The compression relief mechanism of claim 5, further characterized by means for disposing the latch member in its latching position only at engine cranking speeds of crankshaft rotation, and then only during a minor portion of the engine cycle which begins at a time during movement of the valve in said one direction when the valve is at more than said distance from its seat, the last named means comprising:

C. a cam follower movable between defined latch enabling and latch disabling positions;

D. means providing a resilient lost motion connection between the cam follower and the lever whereby movement of the cam follower from its latch enabling position to its latch disabling position imposes bias upon the lever in the direction to urge it out of its latching position and whereby motion of the cam follower in the opposite direction imposes bias upon the lever in the direction to urge it towards its latching position; and E. a centrifugally responsive cam element carried by the camshaft for rotation therewith and for motion relative thereto between one defined position to which said cam element is biased and another defined position to which the cam element is centrifugally propelled against its bias, said cam element being arranged to engage the cam follower only when said cam element is in one of its said positions, and then only during said minor portion of the engine cycle.

8. The compression relief mechanism of claim 7 wherein the cam element engages the cam follower when the cam element is in its said other position to which it is centrifugally propelled, further characterized by:

F. means biasing the cam follower towards its latch enabling position; and

G. another cam element, constrained to rotate with the camshaft and which is arranged to engage the cam follower all during the remainder of the engine cycle, to then hold it in its latch disabling position, said other cam element also being arranged to permit the cam follower to occupy its latch enabling position during said minor portion of the engine cycle provided the first mentioned cam element is then in its said one position to which it is biased.

9. The compression relief mechanism of claim 8 wherein said fulcrum axis is located at the opposite side of the camshaft from said part and the lever curves around the camshaft, and wherein said lever has a non-circular hub portion around its fulcrum axis, further characterized by:

1. said resilient lost motion connection means comprising a hairpin-shaped spring having its bight portion closely embracing said hub portion of the lever and having one leg that has its outer end fixed in relation to the camshaft axis; and
2. the cam follower comprising the outer end portion of the other leg of said hairpin-shaped spring.

* * * * *